US006246304B1

(12) United States Patent
Gasper

(10) Patent No.: US 6,246,304 B1
(45) Date of Patent: Jun. 12, 2001

(54) TRIP INDICATING CIRCUIT BREAKER

(75) Inventor: Thomas G. Gasper, Cambridge, MD (US)

(73) Assignee: Airpax Corporation, LLC, Frederick, MD (US)

( * ) Notice: Subject to any disclaimer, the term of this patent is extended or adjusted under 35 U.S.C. 154(b) by 0 days.

(21) Appl. No.: 09/533,841

(22) Filed: Mar. 23, 2000

Related U.S. Application Data

(60) Provisional application No. 60/126,453, filed on Mar. 26, 1999.

(51) Int. Cl.[7] ..... H01H 73/12; H01H 75/00; H01H 77/00; H01H 83/00

(52) U.S. Cl. ..... 335/17; 340/638

(58) Field of Search ..... 335/17; 340/638, 340/639, 644

(56) References Cited

U.S. PATENT DOCUMENTS

| | | | | |
|---|---|---|---|---|
| 3,596,218 | | 7/1971 | Layton | 335/17 |
| 3,596,219 | | 7/1971 | Erickson | 335/17 |
| 3,742,402 | | 6/1973 | Nicol et al. | 335/13 |
| 3,742,403 | | 6/1973 | Nicol | 335/13 |
| 3,806,848 | | 4/1974 | Harper et al. | 335/188 |
| 3,955,162 | | 5/1976 | Nicol | 335/17 |
| 3,970,976 | | 7/1976 | Nicol | 335/21 |
| 4,251,789 | | 2/1981 | Russell et al. | 335/174 |
| 4,382,270 | * | 5/1983 | Davidson et al. | 361/115 |
| 4,466,042 | | 8/1984 | Zylstra et al. | 361/115 |
| 4,528,531 | | 7/1985 | Flick et al. | 335/23 |
| 4,801,906 | | 1/1989 | Morris et al. | 335/17 |
| 5,089,796 | | 2/1992 | Glennon et al. | 335/172 |
| 5,264,673 | | 11/1993 | Powell | 200/401 |
| 5,264,818 | | 11/1993 | Truchet et al. | 337/79 |
| 5,293,016 | | 3/1994 | Nar | 200/401 |
| 5,777,536 | | 7/1998 | Lee et al. | 335/172 |
| 5,847,913 | | 12/1998 | Turner et al. | 361/93 |
| 5,886,641 | * | 3/1999 | Ulerich et al. | 340/683 |

* cited by examiner

*Primary Examiner*—Ray Barrera
(74) *Attorney, Agent, or Firm*—Milde, Hoffberg & Macklin, LLP

(57) ABSTRACT

A circuit breaker having an external trip indicator, having a circuit breaker housing, a trip mechanism within the housing, sensing a trip condition and being responsive thereto to mechanically break an electrical circuit, an indicator, having a selectively operable retaining mechanism and being biased outward from the circuit breaker housing, and a linkage, sensing a trip condition of the trip mechanism and selectively releasing the selectively operable retaining mechanism to allow the indicator to move outwardly from the housing. The external trip indicator is operated by sensing an overcurrent condition with the trip mechanism, breaking the electric circuit in response to the overcurrent, sensing a mechanical movement of the trip mechanism, and thereby releasing a positional restraint on the mechanical indicator; and allowing the mechanical indicator to protrude from the housing. The external trip indicator is reset by first resetting the trip mechanism and then displacing the mechanical indicator into the housing.

18 Claims, 4 Drawing Sheets

OFF - INDICATING

TRIPPED 1/2 OFF

OFF - RESET

TRIP INDICATING CIRCUIT BREAKER

The present patent application claims benefit of priority from U.S. Provisional Patent Application No. 60/126,453, filed Mar. 26, 1999.

FIELD OF THE INVENTION

The present invention relates to the field of circuit breakers, and more particularly to circuit breakers having an external visual indication of a trip condition.

BACKGROUND OF THE INVENTION

In the field of electrical circuit breakers, it is well known to provide an external indication of the internal state of the circuit breaker, for example ON, OFF, and TRIPPED.

A circuit breaker is a device, which serves to interrupt electrical current flow in an electrical circuit path upon the occurrence of an overcurrent in the circuit path. When the overcurrent occurs, the external toggle handle will normally return to the OFF position. However, a service technician of other user will have no indication whether the breaker was intentionally turned OFF or the breaker tripped. In complex breaker installations, where some breakers are normally maintained in an OFF position, this can make analysis difficult. Therefore, the art has taught the desirability of an external indication of switch state.

Various methods are available for indicating a Trip State of a breaker. First, the external toggle handle may be provided with a "mid-trip" state, intermediate from the ON and OFF states. This is typically accomplished by a linkage between the external toggle and trip mechanism, wherein, upon a trip condition of the breaker, the trip mechanism assumes a state, which causes the external toggle to lie in an intermediate state. See, e.g., U.S. Pat. Nos. 5,264,673, 4,528,531, 3,970,976, 3,955,162, and 3,863,042, expressly incorporated herein by reference. An electronic indicator may also be provided, for example, a light emitting diode, which is selectively illuminated by power from the load. See, e.g., U.S. Pat. No. 3,806,848, expressly incorporated herein by reference, or by means of an auxiliary switch, see, U.S. Pat. Nos. 3,742,402, 3,742,403, 3,863,042 and 3,955, 162, expressly incorporated herein by reference. Some circuit breakers have an internal trip condition distinct from the OFF condition. See, e.g., U.S. Pat. No. 5,777,536. This latter solution, however, causes the problem that in the tripped condition, a small current still flows through the device. Other types of mechanical visual indicators are also possible. See, e.g., U.S. Pat. Nos. 5,847,913; 5,264,818; 5,089, 796; 4,801,906; 4,446,042; 4,382,270; 4,251,789; 3,742, 403; 3,742,402; 3,596,219: and 3,596,218, expressly incorporated herein by reference.

SUMMARY AND OBJECTS OF THE INVENTION

The present invention therefore provides a mechanical latch which, upon tripping of the breaker, allows an externally visible mechanical element to visibly indicate a trip condition.

The mechanical latch does not require substantial modifications or adaptations of the normal circuit breaker and trip mechanisms, and without modification of the form factor or substantial modification of the circuit breaker housing, and thus is compatible with a wide range of breaker designs and applications.

The external mechanical indication of trip state according to the present invention also is manually resettable, although it is possible to provide an additional linkage for resetting the trip indicator while the breaker is reset.

According to a preferred design, a spring loaded plunger is provided protruding through the front of the circuit breaker housing. The plunger itself is designed to be visible, for example having a contrasting color and sufficient physical size. The plunger has a latch portion, disposed internal to the circuit breaker housing, which is capable of selectively retaining the plunger in a non-indicating position. An arm, within the breaker housing, is provided to retain the latch portion during normal use and switching of the breaker. However, during a trip condition, the collapsing mechanism actuates the arm to release it from the latching portion. The latch portion preferably comprises a protruding portion of a cylindrical body of the plunger, while the arm is preferably pivotally mounted within the housing, one end retaining the latch portion while the other end being disposed along a path of a collapsing portion of the trip mechanism, such that during a trip condition, the arm is displaced to release tie plunger to the trip indicating position.

If desired, a mechanism may be provided to automatically reset the external indicator when the circuit breaker is reset. For example, a cam or other linkage may be provided which retracts the external indicator when the handle is moved to the OFF position.

It is therefore an object of the invention to provide an external indicator for a trip state of a breaker which is compatible with existing circuit breaker packaging and form factors.

It is a further object according to the present invention to provide an automatic external indication of circuit breaker trip status.

These and other objects will be apparent from an understanding of the preferred embodiments.

BRIEF DESCRIPTION OF THE DRAWINGS

These and further objects and advantages of the invention will be more apparent upon reference to the following specification, claims and appended drawings wherein:

DETAILED DESCRIPTION OF THE PREFERRED EMBODIMENTS

Figure 2:
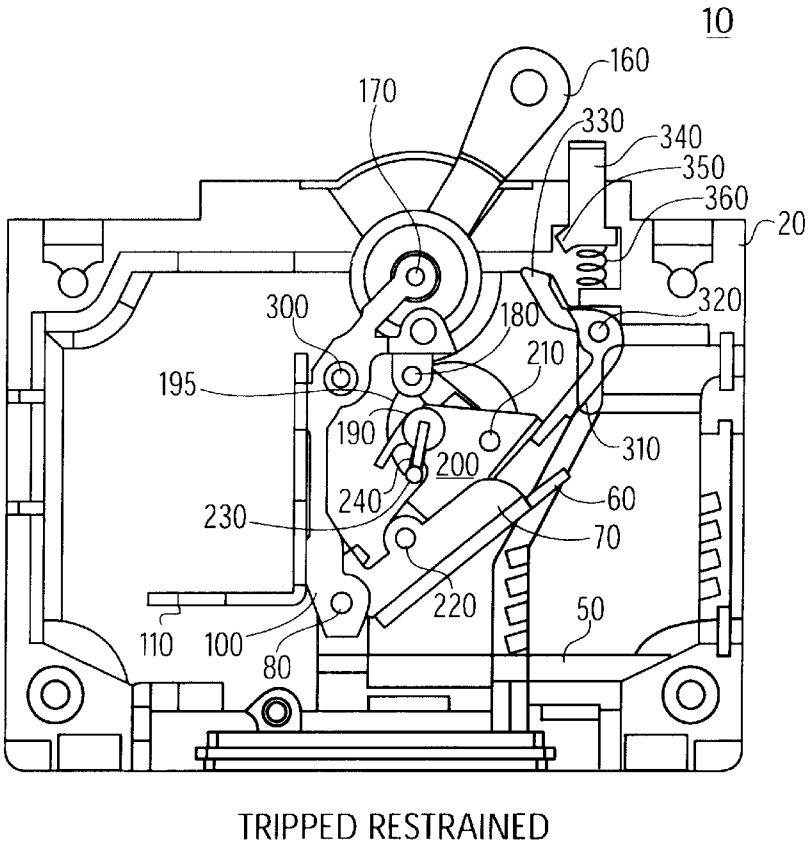
FIG. 2 is a side view of an embodiment of a circuit breaker mechanism having a trip state indicator according to the present invention with a housing half removed, in a contact OFF state, handle restrained in the ON position state, and external trip indication.

The preferred embodiments will no be described by way of example, in which like reference numerals indicate like elements.

EXAMPLE

Components of a conventional type single pole circuit magnetic-hydraulic breaker are well known in the art. See, U.S. Pat. No. 5,293,016, expressly incorporated herein by reference. A single pole circuit breaker 10 includes an electrically insulating casing 20 which houses, among other things, stationary mounted terminals. In use, these terminals are electrically connected to the ends of the electrical circuit that is to be protected against overcurrents. As its major internal components, a circuit breaker includes a fixed electrical contact, a movable electrical contact, and an operating mechanism.

The trip mechanism includes a contact bar, carrying a movable contact of the circuit breaker, which is spring loaded by a multi-coil torsion spring to provide a force repelling the fixed contact. In the closed position, a hinged linkage between the manual control toggle is held in an extended position and provides a force significantly greater than the countering spring force, to apply a contact pressure between the moveable contact and the fixed contact. The hinged linkage includes a trigger element which, when displaced against a small spring and frictional force, causes the hinged linkage to rapidly collapse, allowing the torsion spring to open the contacts by quickly displacing the moveable contact away from the fixed contact. The trigger element is linked to the trip element.

As is known, the casing 20 also houses a stationary electrical contact 50 and an electrical contact 60 mounted on a contact bar 70. Significantly, the contact bar 70 is pivotally connected via a pivot pin 80 to a stationary mounted frame 100. A helical spring (not shown), which encircles the pivot pin 80, pivotally biases the contact bar 70 toward the frame 100 in the counterclockwise direction. A contact bar stop surface limits the pivotal motion of the contact bar 70 relative to the frame 100 in the non-contacting position (contact bar 70 rotated about pin 80 in the counterclockwise direction to separate contacts 50 and 60, shown in FIGS. 2–5). By virtue of the pivotal motion of the contact bar 70, the contact 60 is readily moved into and out of electrical contact with the stationary contact 50. In the contacting position, shown in FIG. 1, the stationary contact 50 limits the motion of the contact 60, thus limiting the angular rotation of the contact bar 70 about pin 80. Thus, in the contacting position, the contact bar 70 is forced by the pressure of the toggle linkage composed of cam link 190 and link housing 200 in the aligned relative orientation, shown in FIG. 1, against a force exerted by the helical spring, to provide firm contact between the contacts 50, 60.

The circuit breaker trip mechanism may be triggered in a number of known ways. Preferably, the trip mechanism is a so-called magnetic or magnetic hydraulic breaker. The trip mechanism sits in the left side of the breaker, on the portion 110 of the frame, receiving the entire current passing through the breaker. An electrical coil, which encircles a magnetic core topped by a pole piece, is positioned adjacent the frame 100. An electrical braid connects the end of the coil to the contact bar 70, proximate to the pivot pin 80. Thus, when the contact bar 70 is pivoted in the clockwise direction, against the biasing force exerted by the spring 85, to bring the contact 60 into electrical contact with the contact 50, a continuous electrical path extends between the terminals of the circuit breaker.

Figure 6B:
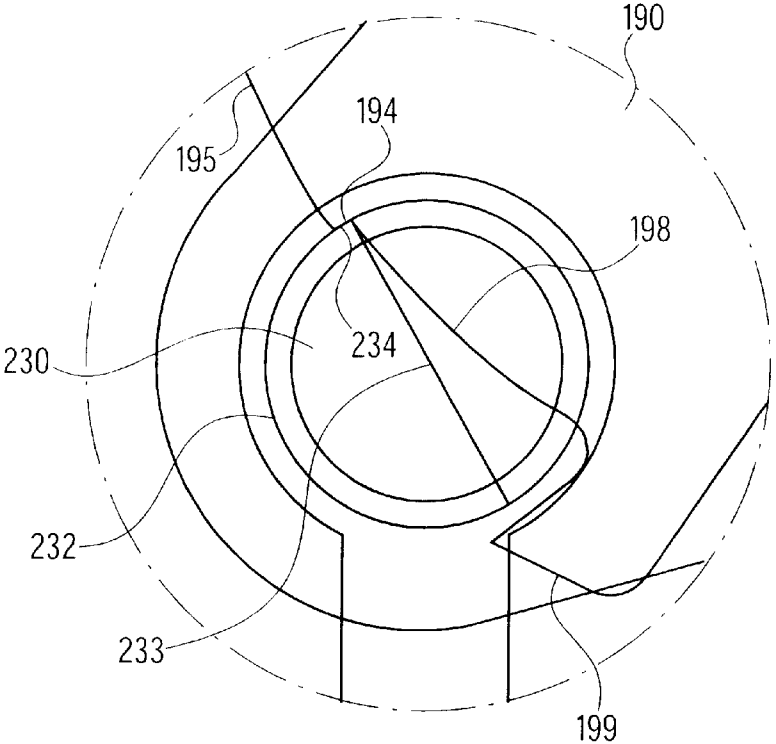
FIGS. 6A and 6B are detail views of a known breaker toggle mechanism.

The circuit breaker 10 also includes a handle 160, which is pivotally connected to the frame 100 via a pin 170. Handle 160 includes a pair of ears with apertures for receiving a pin 180, which connects handle 160 to a cam link 190. In addition, a toggle mechanism is provided, which connects the handle 160 to the contact bar 70. The handle 160 is provided with a helical spring, which applies a counterclockwise force on the handle 160 about pin 170 with respect to frame 100. A significant feature of the cam link 190, shown in expanded view in FIG. 6B, is the presence of a step, formed by the intersection of non-parallel surfaces 194 and 198, in the outer profile of the cam link 190. Cam link 190 is pivotally connected by a rivet or pin 210 to a housing link 200, which in turn is pivotally connected to the contact bar 70 by a rivet 220.

Figure 6A:
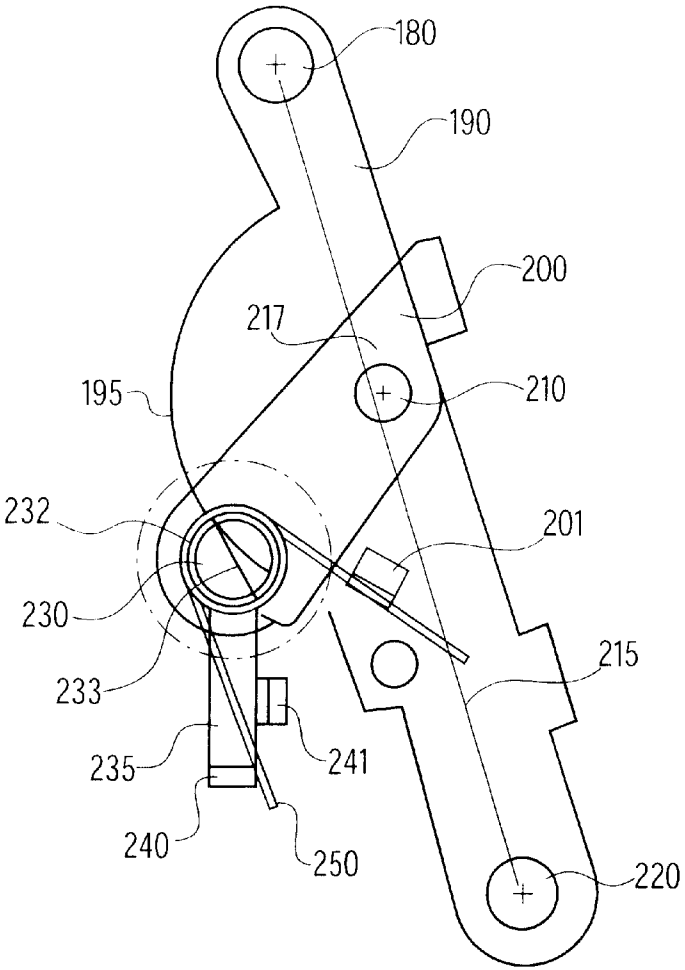

The toggle mechanism further includes a sear assembly, including a sear pin 230 which extends through an aperture in the link housing 200 generally corresponding to a location of an outer edge 195 of the cam link 190. This sear pin 230 includes a circularly curved surface 232 (see FIG. 6B) which is intersected by a substantially planar surface 233. The sear assembly also includes a leg 235 (see FIG. 6A), connected to the sear pin 230, and a sear striker bar 240, which is connected to the leg 235 and projects into the plane of the paper, as viewed in FIG. 6A. A helical spring 250, which encircles the sear pin 230, pivotally biases the leg 235 of the sear assembly clockwise, into contact with the leg 205 of the link housing 200, and biasing the planar surface 233 of the sear pin 230 into substantial contact with the bottom surface 198 of the step in the cam link 190. A force exerted against the sear striker bar 240 is transmitted to the leg 235, and acts as a torque on the sear pin 230 to angularly displace the substantiailly planar surface 233 of the sear pin 230 from coplanarity the surface 198 of the cam link 190, thus raising the leading edge 234 of the substantially planar surface 233 of the sear pin 230 above the top edge of the surface 194. This rotation results in elimination of a holding force for the contact bar 70 in the contacting position, generated by the helical spring 85 acting on the contact arm 70, through the rivet 220 and link housing 200 and sear pin 230 leading edge 234, against the surface 194 of the cam link 190, acting on the pin 180, the ears of handle 160, held in place by pin 170 with respect to the casing 20 and frame 100.

Figure 1:
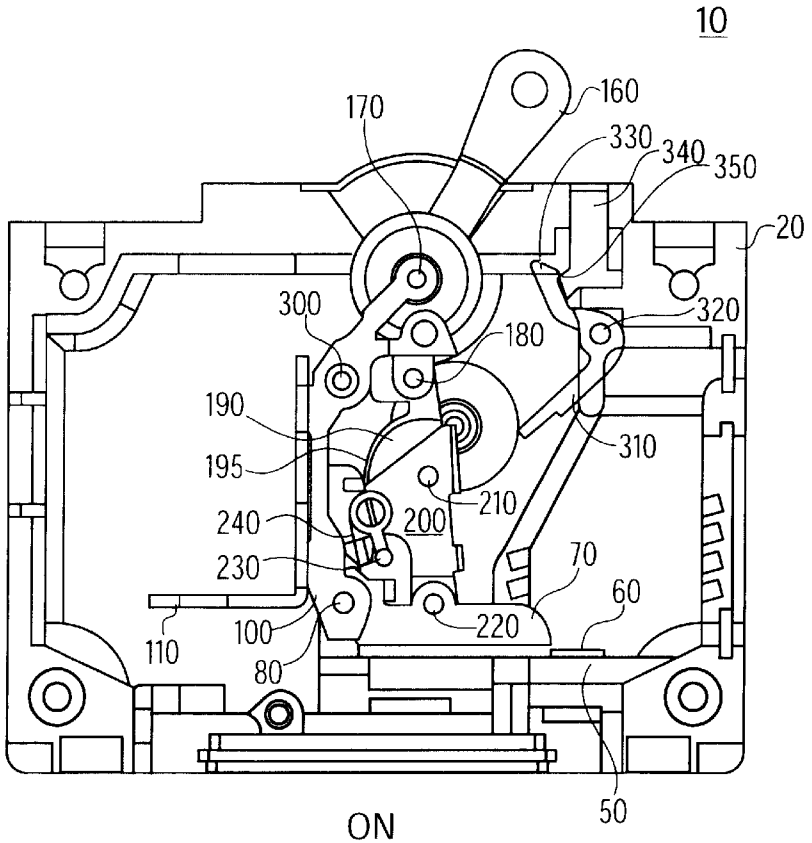
FIG. 1 is a side view of an embodiment of a circuit breaker mechanism having a trip state indicator according to the present invention with a housing half removed, in a normal ON state and no external trip indication.

The initial clockwise rotation of the cam link 190 is limited by a hook 199 in the outer profile of the cam link 190, at a distance from the step, which partially encircles, and is capable of frictionally engaging, the sear pin 230. In addition, the distance from the step to the hook 199 is slightly larger than the cross-sectional dimension, e.g., the diameter, of the sear pin 230. This dimensional difference determines the amount of clockwise rotation the cam link 190 undergoes before this rotation is stopped by frictional engagement between the hook 199 and the sear pin 230. As a consequence, the sear pin 230 engages the step in the cam link 190, i.e., a portion of the surface 194 of the cam link 190 overlaps and contacts a leading portion of the curved surface 232 of the sear pin 230. Thus, it is by virtue of this engagement that the toggle mechanism is locked and thus capable of opposing and counteracting the pivotal biasing force exerted by the spring 85 on the contact bar 70, thereby maintaining the electrical connection between the contacts 50 and 60, as shown in FIG. 1.

Figure 4:
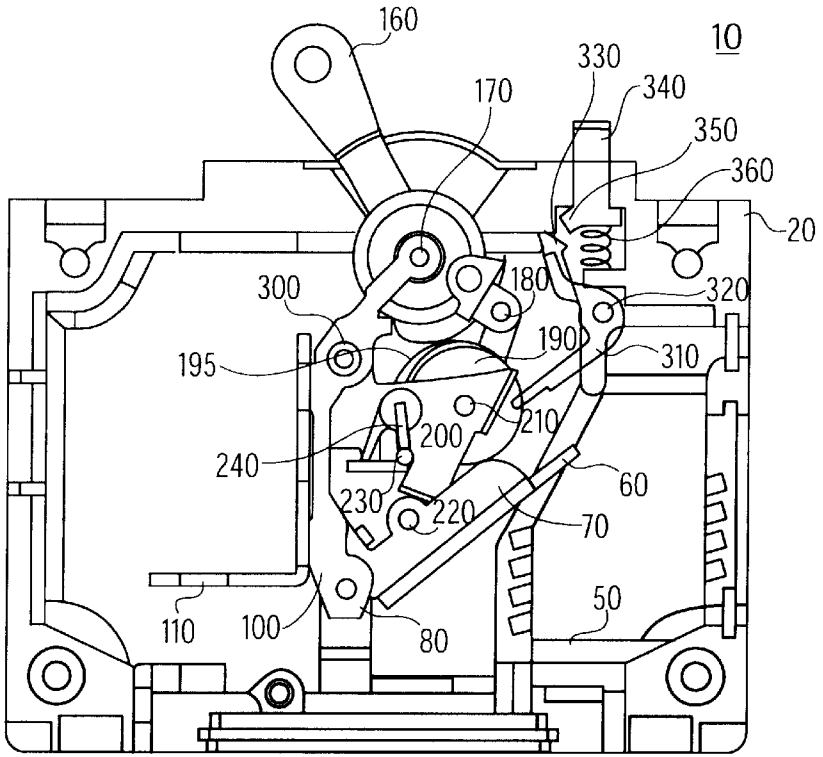
FIG. 4 is a side view of an embodiment of a circuit breaker mechanism having a trip state indicator according to the present invention with a housing half removed, in an OFF state and external trip indication.
Figure 5:
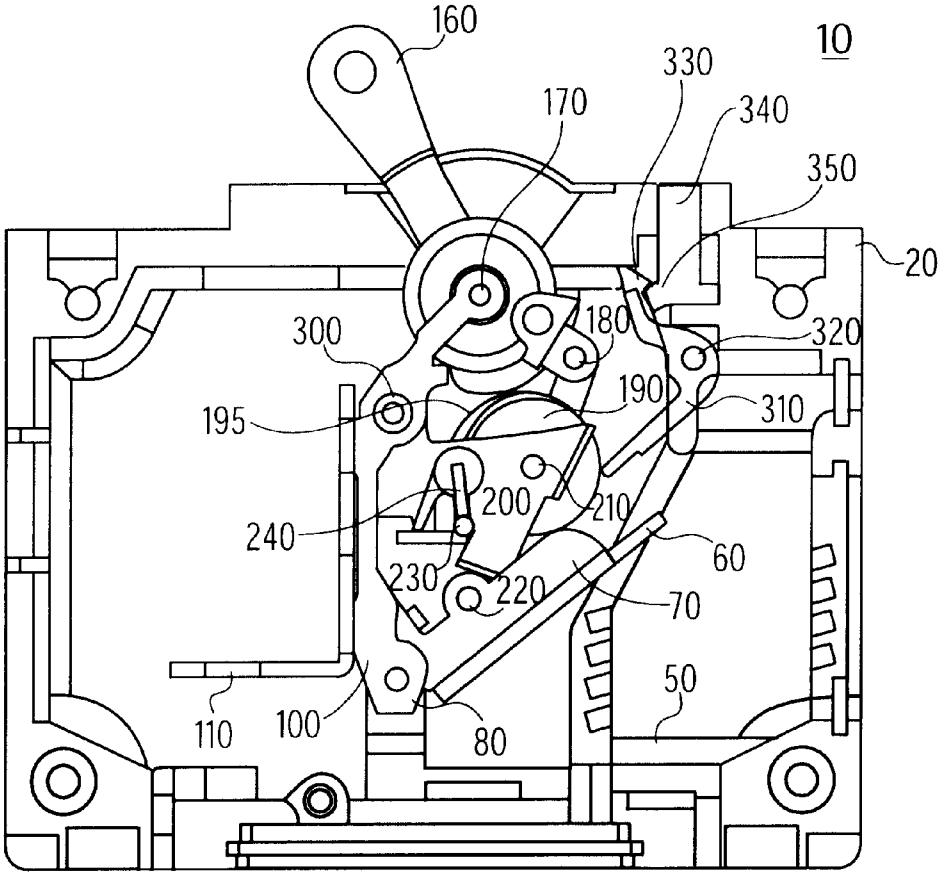
FIG. 5 is a side view of an embodiment of a circuit breaker mechanism having a trip state indicator according to the present invention with a housing half removed, in a contact OFF state handle in the OFF position state, and no external trip indication.

By manually pivoting the handle 160 in the counterclockwise direction, the toggle mechanism, while remaining locked, is translate and rotated out of alignment with the pivotal biasing force exerted by the spring 85 on the contact bar 70. This biasing force then pivots the contact bar 70 in the counterclockwise direction, toward the frame 100, resulting in the electrical connection between the contacts 50 and 60 being broken, thus assuming a noncontacting position. This represents a transition from the state indicate in FIG. 1 to the state indicated in FIG. 5. When in the full counterclockwise position, the handle 160 applies a slight tension or no force on the cam link 190, resulting in a full extension of the cam link 190 with respect to the link housing 200, as shown in FIGS. 4 and 5. In this position, the leading edge of the surface 232 of the sear pin 230 engages the surface 194, and thus the toggle mechanism is in its locked position. Therefore, manually pivoting the handle 160 from the left to right, i.e., in the clockwise direction, then serves to reverse the process to close the contacts 50, 60, since a force against the action of spring 85 is transmitted by clockwise rotation of the handle to the contact bar 70. This represents a transition from the state indicated in FIG. 5 to the state indicated in FIG. 1.

An armature (not shown in the figures), pivotally connected to the frame 100 about pivot 300, includes a leg which is positioned adjacent the sear striker bar 240. In the event of an overcurrent in the circuit to be protected, this overcurrent will necessarily also flow through the coil of the breaker, producing a magnetic force which induces the armature to pivot toward the pole piece. As a consequence, the armature leg will strike the sear striker bar 240, pivoting the sear pin 230 out of engagement with the step (intersection of surfaces 194, 198) in the cam link 190, thereby allowing the force of spring 85 to collapse the toggle mechanism, resulting in the state represented in FIGS. 2 and 3. In the absence of the opposing force exerted by the toggle mechanism, the biasing force exerted by the spring 85 on the contact bar 70 will pivot the contact bar 70 in the counterclockwise direction, toward tile frame 100, resulting in tile electrical connection between the contacts 50 and 60 being broken.

As a safety precaution, the operating mechanism is configured to retain a manually engageable operating handle 160 in its ON (see FIG. 1) or an intermediate, tripped position (see FIG. 3), if the electrical contacts 50, 60 are welded together. Thus, the handle 160 will not assume the OFF position if the contacts are held together. In addition, if the manually engageable operating handle 160 is physically restricted or obstructed in its ON position, the operating mechanism is configured to enable the electrical contacts 50, 60 to separate upon a trip, e.g., due to an overload condition or upon a short circuit or fault current condition. See, U.S. Pat. No. 4,528,531, expressly incorporated herein by reference.

Figure 3:
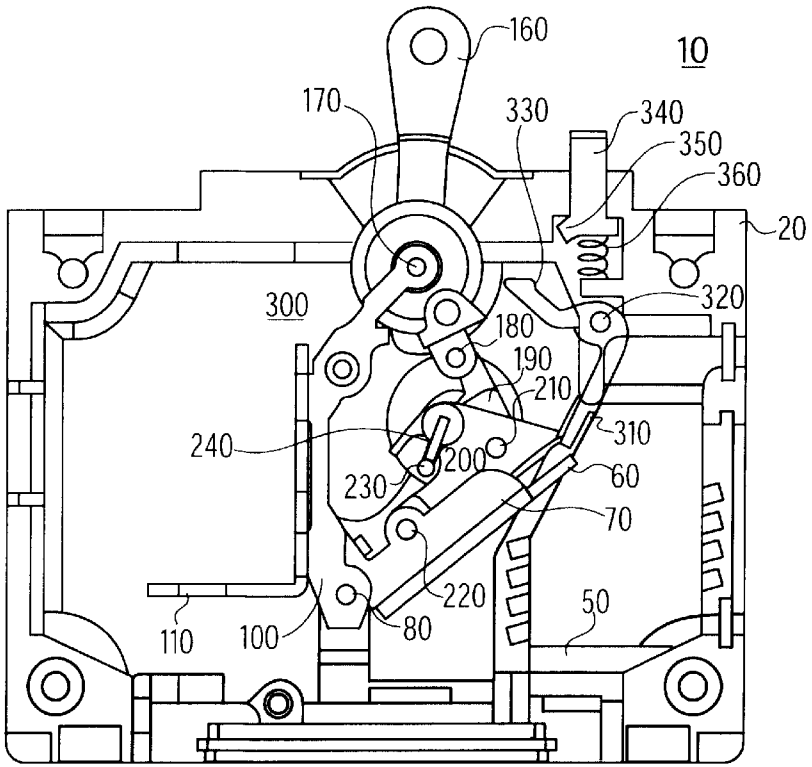
FIG. 3 is a side view of an embodiment of a circuit breaker mechanism having a trip state indicator according to the present invention with a housing half removed, in a contact OFF state, handle restrained in a mid-trip position, and external trip indication.

According to the present invention, a lever arm 310, pivotally mounted by pin 320 to the housing 20 proximate to the trip mechanism, biased in a clockwise direction by a spring (not shown in the figures), is provided having a surface disposed in the path of the link housing 200 as it moves generally diagonally upward toward the right during a trip condition, e.g, a transition from the state indicated by FIG. 1 to the states indicated by the FIGS. 2 or 3. When this occurs, the lever arm 310 pivots about pin 320, and against the bias force of the spring, and disengages the lip of the plunger 340, held by catch 330. The plunger 340 is normally near flush with an upper surface of the housing 20, as shown in the states indicated in FIGS. 1 and 5, and is thus visually unobtrusive or obscured. The plunger 340 is normally held in the depressed state by the catch 330 of lever arm 310 at a lip portion 350, against the externally urging force of spring 360, situated to propel the plunger 340 outward from the housing 20 if unrestrained. However, if the lever arm 310 is rotated clockwise about pin 320, the catch 330 of lever arm 310 disengages the lip portion 350, and the plunger 340 is free to protrude from the housing 20, providing a visual indication of a trip state. The plunger 340 may then be manually reset by depression thereof into the housing 20, after the circuit breaker mechanism is reset into the state indicated by FIGS. 1, 4 or 5.

As seen in FIGS. 2 and 3, when the toggle linkage collapses, as due to an overcurrent, the seer pin 240 is rotated about axis 230, and the cam link 190 folds into the link housing 200. In this condition, the link housing depresses the lever arm 310, releasing the catch 330 from the lip portion 350 of the plunger 340. The plunger 340 will only remain inside the housing 20 when manually depressed if the toggle linkage is reset into the states indicated in FIGS. 1, 4 or 5.

In summary, FIG. 1, shows the lever arm 310 restraining the lip portion 350 of the plunger 340, and the contacts 50, 60 and external handle 160 are in the ON state. FIG. 2, on the other hand, shows a trip state wherein the external handle 160 is restrained in the ON position. The link housing 200 of the collapsible toggle linkage presses against the lever arm 310, thereby releasing the plunger 340 preventing a manual reset thereof, until the circuit breaker 10 is reset.

FIG. 3 shows the breaker in a mid-trip state. In this case, the external handle 160 further displaces the lever arm 310 beyond the state represented in FIG. 2.

FIG. 4 shows the external toggle in the OFF state, with the collapsible toggle linkage reset. The lever arm 310 is in the normally biased position. FIG. 5 shows the circuit breaker 10 in the same state as in FIG. 4, but the plunger 340 has been manually reset and is held in place by the lever arm 310.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

The term "comprising", as used herein, shall be interpreted as including, but not limited to inclusion of other elements not inconsistent with the structures and/or functions of the other elements recited.

What is claimed is:

1. A circuit breaker having an external trip indicator, comprising:

a circuit breaker housing;

a trip mechanism within said housing, sensing a trip condition and being responsive thereto to mechanically break an electrical circuit;

an indicator, having a retaining surface and a selectively operable retaining mechanism comprising a lever arm mounted for rotation within said housing, having a catch which selectively engages said retaining surface, said indicator being biased outward from said circuit breaker housing; and a linkage, sensing a trip condition of said trip mechanism and selectively releasing said selectively operable retaining mechanism to allow said indicator to move outwardly from said housing.

2. The circuit breaker according to claim 1, wherein said indicator comprises a plunger disposed adjacent to a manual electrical circuit control element on said housing.

3. The circuit breaker according to claim 2, wherein said plunger is biased outwardly from said housing by a spring.

4. The circuit breaker according to claim 3, wherein said retaining surface comprises a retaining lip.

5. The circuit breaker according to claim 4, wherein said trip mechanism displaces said lever arm to release said catch from said retaining lip upon occurrence of a trip condition.

6. The circuit breaker according to claim 4, wherein said trip mechanism has a pivotal axis, and wherein said lever arm has an axis of rotation, said pivotal axis of said trip mechanism and said axis of rotation of said lever arm being parallel.

7. The circuit breaker according to claim 6, wherein said trip mechanism is mounted to a frame within said housing and said lever arm rotates about a pin held in fixed position by said housing independently of said frame.

8. The circuit breaker according to claim 1, wherein said trip condition comprises an overcurrent in a magnetic coil.

9. The circuit breaker according to claim 1, wherein said trip mechanism comprises a collapsible toggle linkage, wherein said collapsible toggle linkage moves through a path intersecting said lever arm during a trip condition, to thereby rotate said lever arm and release said catch from engagement with said retaining surface.

10. A method for indicating a trip condition in a circuit breaker, having a housing, comprising the steps of:

providing a mechanical indicator, having an axis of movement protruding out of the housing;

providing a trip mechanism, within the housing, adapted to respond to an electrical overcurrent trip condition to break an electric circuit;

sensing an overcurrent condition with the trip mechanism;

breaking the electric circuit in response to the overcurrent;

sensing a mechanical movement of the trip mechanism, and thereby releasing a positional restraint on the mechanical indicator; and allowing the mechanical indicator to protrude from the housing, wherein the positional restraint on the mechanical indicator is selectively operable, and comprises a lever arm mounted for rotation within said housing, having a catch which selectively engages a retaining surface of the mechanical indicator.

11. The method according to claim 10, further comprising the steps of resetting the trip mechanism and then displacing the mechanical indicator into the housing.

12. The method according to claim 10, wherein the mechanical indicator comprises a plunger, disposed adjacent to a manual electrical circuit control element on the housing.

13. The method according to claim 12, further comprising the step of biasing the plunger outwardly from the housing with a spring.

14. The method according to claim 10, wherein the retaining surface comprises a retaining lip of the mechanical indicator.

15. The method according to claim 14, wherein the trip mechanism has a pivotal axis, and wherein the lever arm has an axis of rotation, the pivotal axis of the trip mechanism and the axis of rotation of the lever arm being parallel.

16. The method according to claim 15, wherein said the mechanism is mounted to a frame within the housing and the lever arm rotates about a pin held in fixed position by the housing independently of the frame.

17. The method according to claim 10, further comprising the step of sensing an overcurrent in a magnetic coil for generating the trip condition.

18. The method according to claim 10, wherein the trip mechanism comprises a collapsible toggle linkage which collapses and moves through a path intersecting the lever arm during a trip condition, further comprising the steps of collapsing the collapsible toggle linkage, rotating the lever arm by contact from the collapsible toggle linkage, and releasing the catch from engagement with the retaining surface.

* * * * *